US005932856A

United States Patent [19]

Lopes et al.

[11] Patent Number: 5,932,856

[45] Date of Patent: Aug. 3, 1999

[54] POWER SWITCH TO PREVENT INADVERTENT ACTIVATION OF AN EMERGENCY LOCATING BEACON

[75] Inventors: Jaupes B. Lopes, Boca Raton; Jody H. Akens, Weston; Mark S. Clark, Ft. Lauderdale, all of Fla.

[73] Assignee: ACR Electronics, Inc., Fort Lauderdale, Fla.

[21] Appl. No.: 09/185,293

[22] Filed: Nov. 3, 1998

[51] Int. Cl.[6] ..... H01H 3/16; H01H 9/00

[52] U.S. Cl. ..... 200/61.58 R; 200/61.82; 200/61.7; 335/1; 335/202; 335/205; 335/206; 335/238

[58] Field of Search ..... 335/1, 202, 205–208, 335/238, 260, 278; 200/52 R, 61.58 R, 61.7, 61.8, 61.81, 61.82, 332, 335; 455/90

[56] References Cited

U.S. PATENT DOCUMENTS 4,063,056 12/1977 Baker ..... 200/332

*Primary Examiner*—Michael L. Gellner
*Assistant Examiner*—Raymond Barrera
*Attorney, Agent, or Firm*—Malin, Haley, DiMaggio & Corsby, PA

[57] ABSTRACT

A power switch for use with a personal locator beacon (PLB), or an emergency position indicating radio beacon (EPIRB), that prevents accidental activation of the beacon to prevent false alarm transmission of emergency signals. The personal locator beacon includes electronic circuitry housed in a portable hand-held housing that includes a fail safe power switch which has a lever arm that is selectively movable between first and second offset recessed cavities formed in the housing. The lever arm is rotatable about a shaft between an "off" position wherein the lever arm is received within the first cavity, and an "on" position wherein said lever arm is received within the second cavity. An edge portion formed by the offset cavities stops the lever arm from rotating from the first position to the second position unless the lever arm is manually moved laterally along the shaft to clear the edge portion. The intermediate position between the "on" and the "off" positions can be a test position to check the battery and associated circuitry. Rotation of the lever arm from the second position back to the first position, causes the lever arm to engage a beveled edge of one side of the offset cavity thereby forcing the lever arm laterally along the shaft back to alignment with the first recessed cavity.

11 Claims, 3 Drawing Sheets

POWER SWITCH TO PREVENT INADVERTENT ACTIVATION OF AN EMERGENCY LOCATING BEACON

BACKGROUND OF THE INVENTION

1. Field of the Invention

This invention relates generally to a manually actuated electrical switching device for preventing inadvertent activation of electrically powered circuitry, and, particularly, to a manually actuated on/off power switch, for an emergency position indicating radio beacon (EPIRB) or personal locating beacon (PLB), that prevents inadvertent manual activation of the power switch, and thus inadvertent activation of the device and transmission of RF energy signals, thereby preventing the unnecessary deployment of search and rescue forces.

2. Description of Background Art

An emergency position indicating radio beacon, and similarly a personal locator beacon, transmits emergency geographical latitude and longitude positional information by radiating an RF signal at a predesignated specific RF frequency, or frequencies, allotted only for use in emergency situations in order to aid search and rescue and/or police and military activities in locating the person in possession of the radio beacon.

EPIRBs are commonly deployed on marine vessels for manual activation in an emergency situation. The EPIRBs are commonly stored in an easily accessible location for quick deployment in the event that an emergency situation arises. Once activated, the EPIRB transmits signals that can either provide direction finding information, such as radar direction information, to search and rescue vehicles, or transmits identification beacon signals that may be received by Search and Rescue Satellite Aided Tracking (SARSAT) satellites in orbit around the earth.

SARSAT uses the identification beacon signal received from an EPIRB to determine approximate position coordinates of the EPIRB, and transmits the approximate geographic latitude and longitudinal positional coordinates of the transmitting EPIRB, along with other pre-programmed information received from the EPIRB, such as the name of the vessel, to ground stations. The ground stations then relay the information to a rescue coordination center which deploys rescue craft to the approximate EPIRB position to begin search and rescue operations. In addition, direction finding signals from the EPIRB may be directly received by search and rescue vessels and aircraft capable of receiving such transmissions to help locate the transmitting EPIRB.

Operation of an EPIRB as described above, is fully disclosed in U.S. Pat. No. 5,218,366, issued to Cardamone et al. Since EPIRB's are battery powered, the power switch typically has a test position to check the battery charge to make sure that the device is fully capable of transmitting an emergency signal, even though a signal is not transmitted when the switch is in the test position.

Another type of outdoor emergency geographical position locating device is a personal locator beacon (PLB). This device includes a radio transmitter that transmits an RF frequency signal at predetermined emergency frequencies, similar to an EPIRB, and can be used outdoors by campers, hikers, skiers, mountain climbers, boaters, or anyone that may find themselves lost, or in a survival situation, and in need of emergency assistance. Again, the PLB has a manually actuated power switch for activation and the switch typically includes a test position for testing battery capacity without actually transmitting a signal.

EPIRB's and PLB's are typically fabricated with a watertight, rigid plastic housing since they are most often used in outdoor or marine environments. Accordingly, the power switch used to operate the EPIRB or the PLB must therefore be disposed within a waterproof environment. These devices also include an antenna that is connected to the electrical circuitry inside for radiating energy outwardly.

Accordingly there exists a need for a water-proof, manually actuated power switch having positions for power on, power off, and battery test, that is not subject to inadvertent actuation, for use with emergency rescue transmitting devices and the like.

SUMMARY OF THE INVENTION

The present invention provides an improved manually-actuated power switch that is structurally integrated into the waterproof housing of an EPIRB or a PLB. The manually-actuated power switch has an on position, an off position, and a test position for testing whether the batteries are charged.

In order to maintain the water tight integrity of the rigid plastic housings used with EPIRB's and PLB's, reed switch technology is employed. Specifically, a switch according to the present invention includes an externally mounted lever arm having a magnet embedded therein. The EPIRB or PLB circuitry which is located inside the plastic housing includes at least one magnetically actuated reed switch adjacent the switch area, which, when properly aligned with the magnet in the switch lever arm, will assume a closed position thereby causing the circuit to turn on. The lever arm is normally positioned in the "off" position, and when the lever arm is rotated 180° away from the "off" position, it is placed in the "on" position wherein the magnet in the lever arm closes a reed switch the electronic transmitting circuit is turned on. With the lever arm at a 90° position vertically, the test switch or light will go on to show that the battery is operable.

The lever arm switch is mounted on one end to a cylindrical shaft that is connected to the housing and that allows the switch to rotate, preferably through 180° of travel. The housing includes first and second recessed cavities, in offset alignment, preferably in the top portion of the housing that receives the lever arm of the switch. The first and second recessed cavities are premolded when the housing is formed, and each recessed cavity is sized to accommodate the width of the lever arm. The recessed cavities, however, are laterally offset such that the longitudinal center line of the first recessed cavity is laterally offset from a longitudinal center line of the second recessed cavity. The purpose of the offset is to prevent the switch lever arm from being moved from the "off" position, wherein the lever arm is received within the first recessed cavity, to the "on" position, wherein the lever arm is received within the second recessed cavity without requiring manually the physical movement laterally of the switch lever arm. A spring may be included to resist lateral movement of the lever arm.

The lever arm also includes a cylindrical cam like protrusion about the portion that is mounted to the shaft. A resilient metal plate, that acts like a spring, is mounted in a well that extends between the first and second recessed cavities and engages the cam of the lever arm which cam puts tension on the spring plate by pushing downward when the switch lever is rotated. The spring tension from the resilient plate prevents the switch from moving by providing tension on the lever arm that resists rotational and lateral movement. Without the spring plate the lever arm would be freely rotatable and could flip flop around and may accidentally allow the switch to be turned on through movement of the EPIRB or PLB. Thus it requires a certain amount of manual force to rotate the lever arm regardless of whether it is in the "on," "off," or in the test position. However, because of the offset of the first and second recessed cavities there is a small wall that prevents rotation of the lever arm past the 90° vertical position, which is the test position. In order to continue on to the "on" position of the switch, the operator must physically push the lever arm in a lateral direction so that it aligns up with the laterally offset second recessed cavity and clears the wall, such that the lever can be rotated manually into the second recessed cavity allowing the magnet in the lever arm to magnetically interact with the reed switch inside the housing which turns on the power. The resilient spring plate has a angled or tapered edge that allows the lever arm to slide laterally against some tension and to have some tension when it is manually positioned to the on position.

The EPIRB or PLB housing may come in two segments, an upper cap and a lower main housing, so that access to the circuitry and batteries can be achieved for changing batteries when desired. In the preferred embodiment, the switch described above is preferably located in the housing cap which includes one or more visible light emitting devices that are connected through a watertight seal in the cap. The cap is connected to the lower main housing through a watertight seal so that water cannot get into the housing when it is sealed thereby protecting the circuitry and the batteries. The unit also includes a deployable antenna for transmission of the emergency RF signals when the system is turned on.

The switch may thus be switched from the "off" position, to the "test" position, and then to the "on" position by the rotating and sliding the lever arm as just described. When "off", the lever normally rests in the first recessed cavity making inadvertent or accidental rotation of the switch highly unlikely. However, if the lever were accidentally rotated out of its recessed position, it can only be rotated 90 degrees about the shaft because the wall defined by the second recessed cavity will stop the lever from continuing rotation. Accordingly, the user must manually apply force laterally to the lever such that the lever slides along the shaft and clears the wall defined by the offset recessed cavity to enable rotation beyond 90 degrees to reach the "on" position. As is apparent, the switch cannot be rotated more than 90 degrees without sliding the switch along the shaft to clear the edge of the offset recessed cavity, and cannot be inadvertently turned to the "on" position. Therefore, when testing the unit, the lever arm will automatically stop in the test position and will only proceed to the "on" position by the positive action of the operator as described.

When the switch is in the "on" position and it is desired to turn the switch back to the "off" position, the switch is rotated 180 degrees in the opposite direction as described above, or rotated from the "on" position to the "off" position. However, the edge portion of the first recessed cavity forms a beveled wall that contacts the switch, when the switch is rotated in toward the "off" position, in such a manner that when the switch contacts the beveled wall as the switch is rotated, the switch is automatically slid along the shaft in the opposite direction from the manual sliding movement required above to turn the switch to the "on" position. As the switch is rotated and simultaneously slid along the shaft, the switch passes the 90 degree position and is automatically slid laterally into position to continue rotation back into the first recessed cavity and hence back to the "off" position.

Therefore, the switch can be flipped easily and quickly from the "on" position to the "off" position in one continuous rotation. However, as described above, the switch must be manually slid while being rotated to switch from the "off" position to the "on" position. Accidental and/or inadvertent activation of the EPIRB or personal locating beacon of the present invention is thus prevented, even if the lever arm is turned to the test position.

It is an object of the present invention to provide a hand-held EPIRB or PLB with an improved manually actuated power switch that prevents inadvertent activation of the device.

In accordance with these and other objects which will become apparent hereinafter, the instant invention will now be described with particular reference to the accompanying drawings.

DESCRIPTION OF THE PREFERRED EMBODIMENTS

Figure 1:
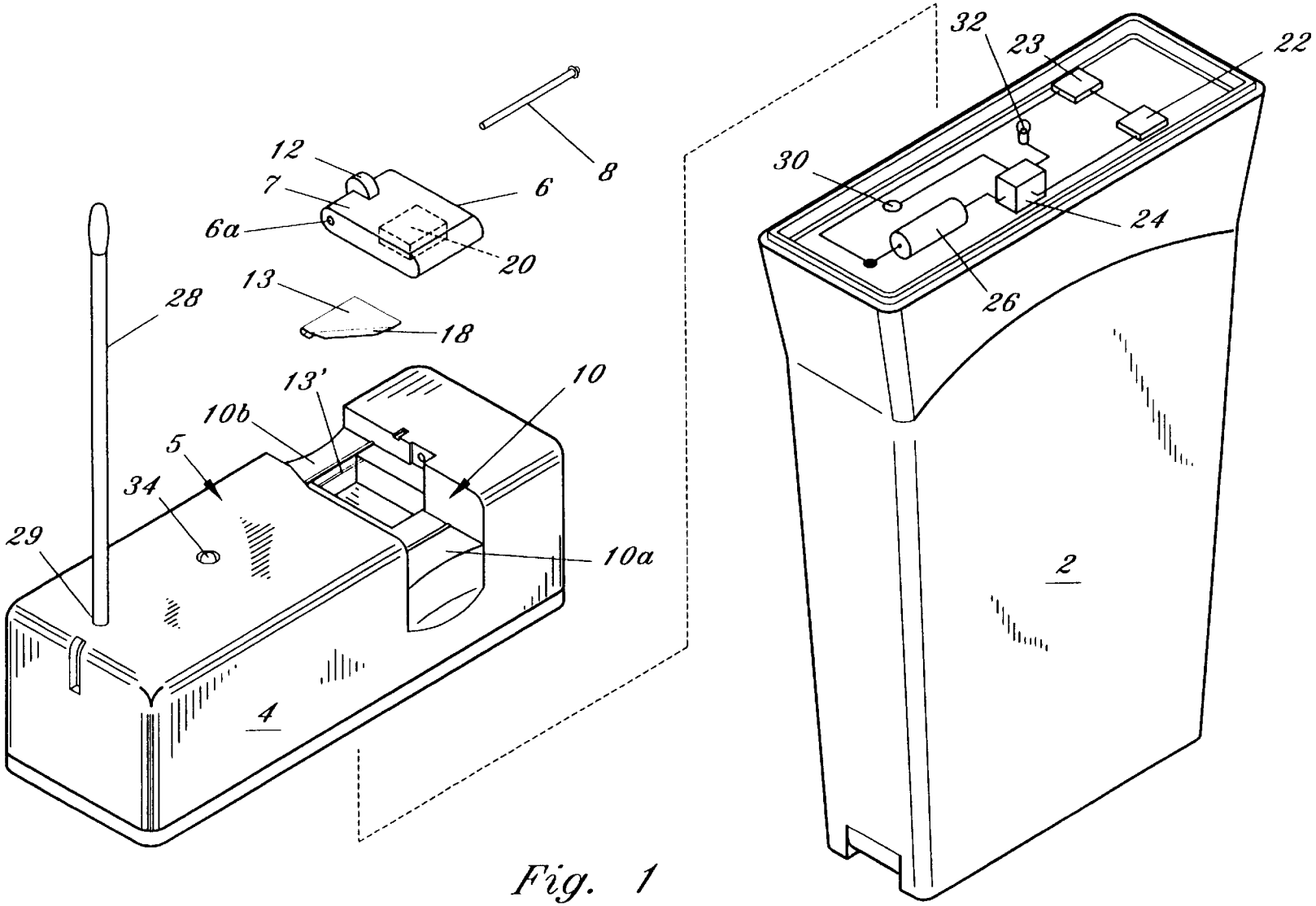
FIG. 1 is a partially exploded perspective view of the improved switch and radio beacon housing of the present invention.
Figure 2A:
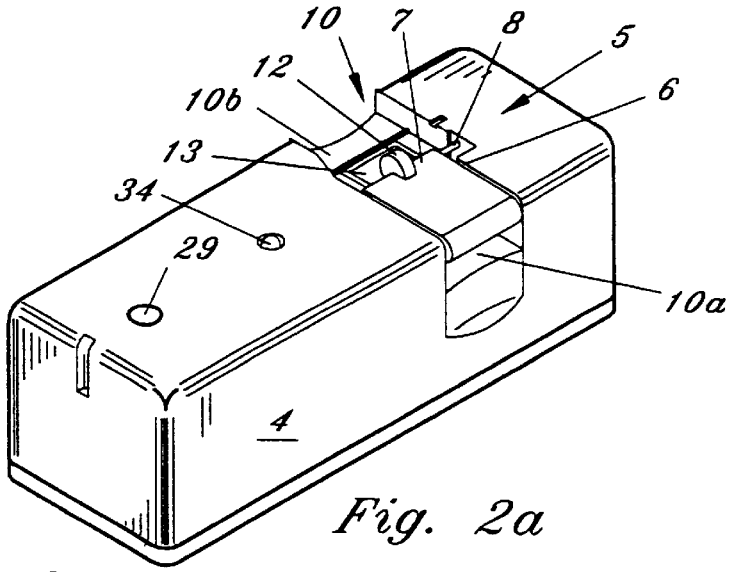
FIG. 2*a* is a top perspective view of the housing cap showing the switch lever arm in the "on" position.
Figure 2B:
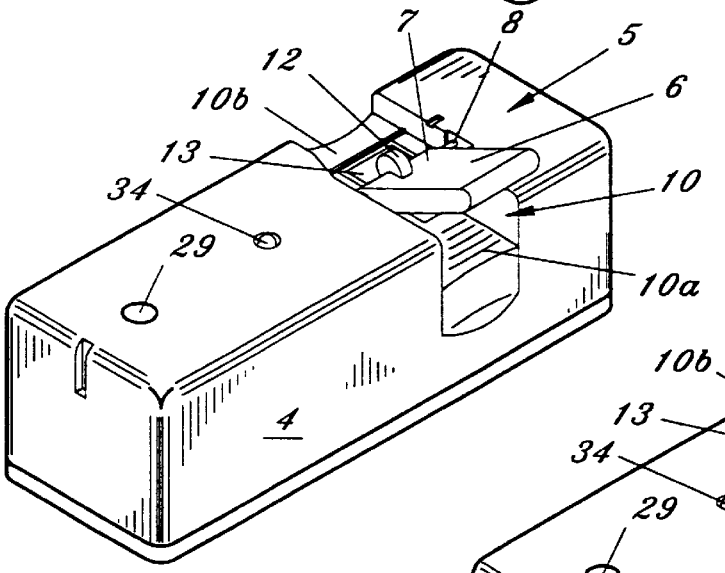
FIG. 2*b* is a top perspective view of the housing cap showing the switch lever arm in an intermediate position.
Figure 2C:
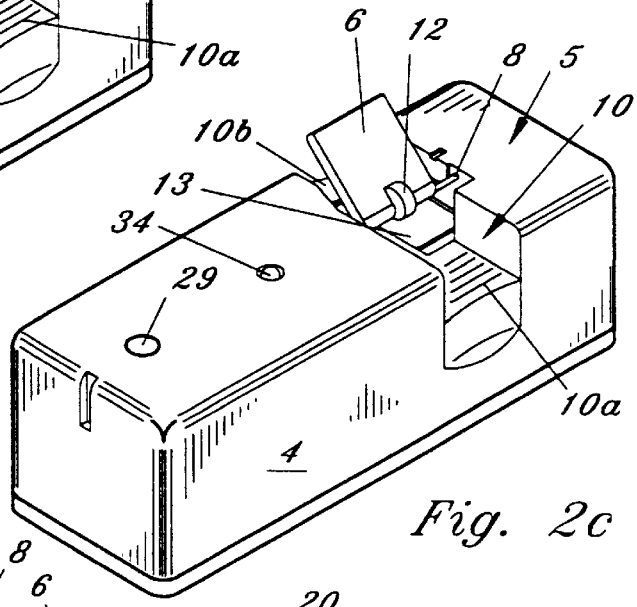
FIG. 2*c* is a top perspective view of the housing cap showing the switch lever arm in another intermediate position.

FIG. 1 shows the preferred embodiment of the present invention. The handheld EPIRB or PLB is shown having a lower housing 2 that receives the circuitry and contains batteries for powering the device, and housing cap 4 which, in its operational position, is sealably mounted to the lower housing 2 and provides a waterproof housing for the device. Housing cap 4 has attached thereto an antenna 28 which has a waterproof seal, referenced as 29, through the housing cap 4. A test light emitting device 34 is also visible at the top of cap 4, and is sealably mounted to circuitry inside the device so as to maintain the water-tight integrity of the device. In the test position light 34 will illuminate as described below.

The housing cap 4 includes first and second recessed cavities, referenced as 10*b* and 10*a* respectively, which are offset laterally along their center line longitudinal axis. A switch lever arm 6 includes a magnet 20, for reasons more fully discussed herein. Switch lever arm 6 is movably connected to cap 4 via cylindrical shaft 8, and is the component that is manually manipulated by the user between the "on," "off," and "test" positions. Specifically, switch lever arm 6 is rotatably connected to housing cap 4 by a rigid cylindrical shaft 8 that is received in a cylindrical channel 6*a* disposed at one end of lever arm 6. Also at that end of the lever arm is a cylindrical cam-like surface 12 that is integrally formed and molded as a unit with switch lever arm 6.

Housing cap 4 further includes a resilient plate 13 that fits into a recessed well 13' in the middle bottom portion of recessed areas 10*a* and 10*b* in housing cap 4. Resilient plate 13 is preferably formed from metal, such as spring steel. The resilient plate 13 has a bent end portion that is fixedly secured to housing cap 4 by a suitable mating recessed well structure 13'. The bent end portion of resilient plate 13 allows it to be rigidly attached to the recessed well structure 13' so that downward deflection by the lever arm cam surface 12 bears against the plate providing tension and spring pressure on the lever arm 6, thus requiring manual force to rotate the lever arm or otherwise move it. As is apparent, resilient plate 13 prevents the lever arm from being loose.

The lower housing 2 defines a hollow interior that primarily houses one or more batteries to power the PLB and/or and EPIRB. Lower housing 2 is preferably made of a rigid waterproof material, such as preformed plastic. Reed switches 22 and 23 are represented schematically, and are magnetically actuated by magnet 20 in lever arm 6. Each reed switch is a normally open switch that is actuated to a closed position when a magnet, such as magnet 20, is positioned substantially adjacent thereto. Each reed switch is disposed within the watertight housing structure, and the invention contemplates that the magnetic field surrounding magnet 20 will act on a reed switch through the housing wall.

FIG. 1 further schematically illustrates that the reed switches are integral components in an electrical system that further includes a control circuit 24, a battery source 26, an antenna output 30 connected to an antenna 28, and a test light 34. The electrical components are shown schematically for simplicity. The control circuit 24 is responsible for generating a signal at the proper RF emergency frequencies or frequency when the power switch is in the "on" position, such that a signal is conveyed to the antenna output 30 which is connected to antenna 28. When switch lever 6 is moved to its "test" position, the control circuit provides electrical power from battery 26 to light emitting device 32. When switch lever 6 is positioned to the "off" position, the entire system is turned off.

In an alternate embodiment, some or all of the electronic components may even be mounted inside the housing cap 4 rather than on lower housing 2. The purpose for the split housing with the cap 4 and the lower housing 2 is to allow access to the batteries for inspection, maintenance, and/or changing. A waterproof seal is placed around the housing between the cap 4 and the lower housing 2 when they are joined together. Accordingly, when assembled, the device forms a rigid plastic two piece waterproof PLB or EPIRB housing that contains the batteries, the circuitry for generating the RF signals to be transmitted by the outside antenna when the power switch is placed in the "on" position.

Referring to FIGS. 2*a*, 2*b*, and 2*c*, and 3*a*–3*d*, the housing cap 4 has attached thereto switch lever 6. The lower end, referenced as 7, of lever arm 6 is rotationally and slidably mounted onto shaft 8, and lever arm 6 is generally free to rotate about shaft 8. When in the "off" position, lever 6 rests within cavity 10*b* flush with upper surface 5. When in the "on" position, lever arm 6 rests within cavity lob flush with upper surface 5. Cavity 10*a* and cavity 10*b* are connected together near lever arm end 7, and together form continuous offset cavity 10.

Figure 3C:
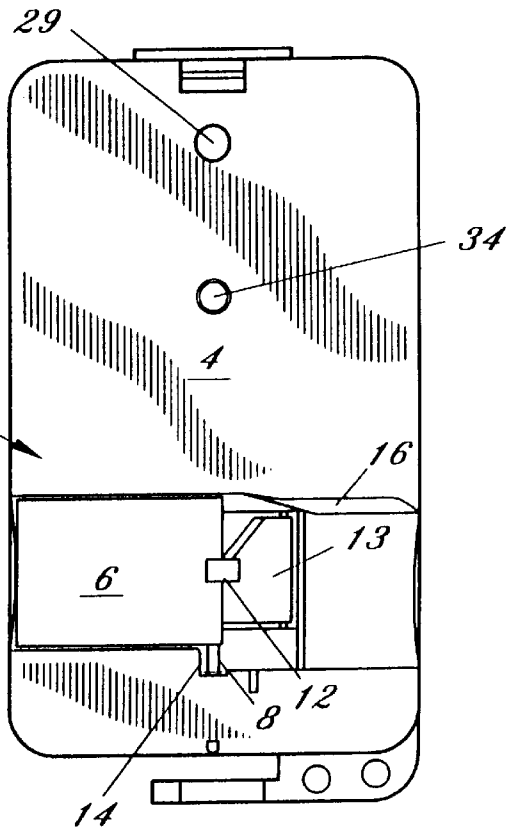
FIG. 3*c* is a top plan view of the present invention showing the switch lever arm in the "on" position.
Figure 3B:
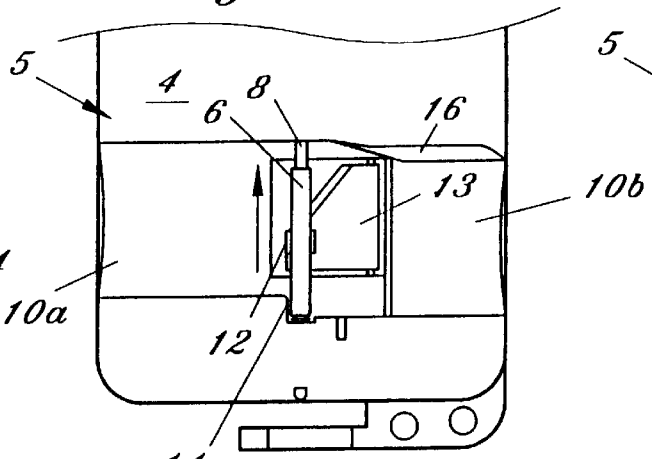
FIG. 3*b* is a partial top plan view of the present invention showing the switch lever arm in the "test" position.
Figure 3D:
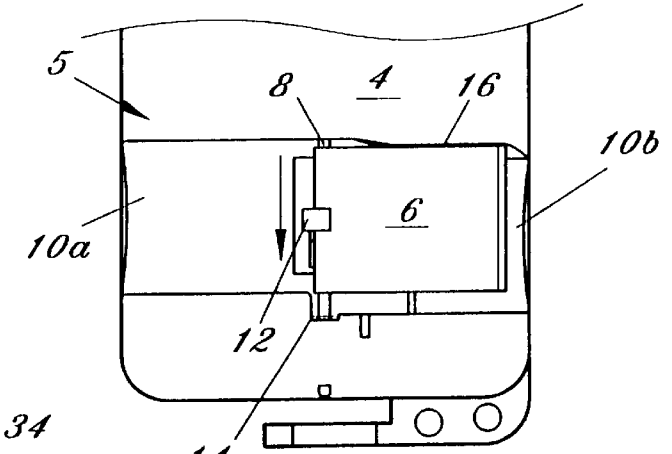
FIG. 3*d* is a partial top plan view of the present invention showing the switch lever arm returning to the "off" position.
Figure 3A:
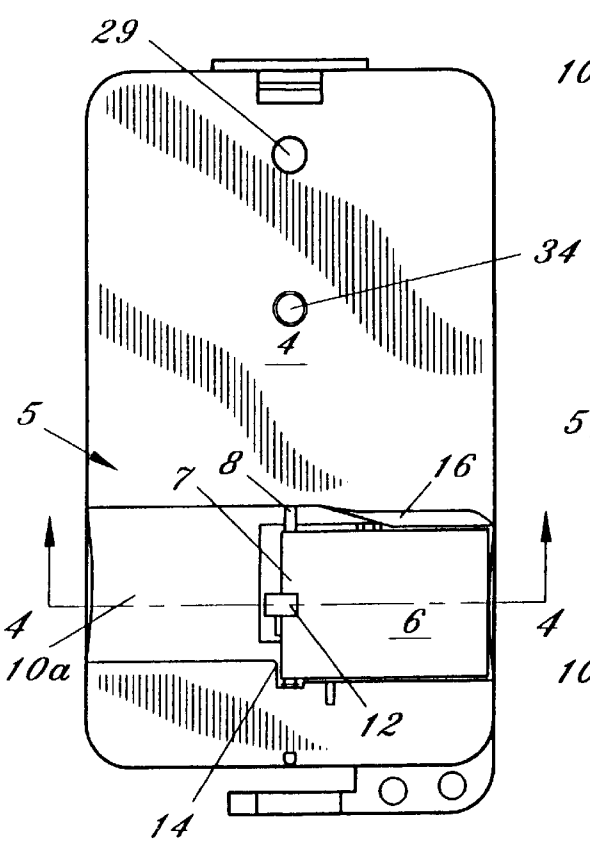
FIG. 3*a* is a top plan view of the present invention showing the switch lever arm in the "off" position.

Referring now to FIGS. 3*a* through 3*c*, the sequence of moving lever arm 6 from the "off" position in cavity 10*b* to the "on" position in offset cavity 10*a* is shown. In FIG. 3*a*, lever arm 6 is shown in the "off" position within cavity 10*b*. FIG. 3*b* shows lever arm 6 in the "test" position, wherein lever arm 6 is rotated 90 degrees about shaft 8 from the "off" position until lever arm 6 contacts and is stopped by wall 14. As previously discussed, the "test" position is used to check the charge of the battery source. To activate the device for the purpose of transmitting signals, lever arm 6 must then be slid along shaft 8 in the direction away from edge 14 until lever arm 6 is aligned within cavity 10*a* at which time lever arm 6 can continue to be rotated about shaft 8 beyond 90 degrees and into the "on" position wherein lever arm 6 is received within cavity 10*a*, as shown in FIG. 3*c*.

To move lever arm 6 from the "on" position back to the "off" position, the sequence is reversed, with one exception. When lever arm 6 is rotated about shaft 8, i.e. rotated back 90 degrees relative to the "on" position within cavity 10*a*, lever arm 6 contacts beveled surface 16 which urges lever arm in the direction indicated by the arrow in FIG. 3*d*. Unlike, edge 14, the shape of beveled surface 16 automatically slides lever arm 6 toward edge 14 and toward alignment with cavity 10*b*, as lever arm 6 is manually rotated about shaft 8. As rotation of lever arm 6 continues past 90 degrees, lever arm 6 is automatically forced into alignment with cavity 10*b* by beveled surface 16. Lever arm 6 will thus continue rotating past 90 degrees and into cavity 10*b* in one smooth rotation, and hence into the "off" position. In one embodiment, lever arm 6 can be biased toward edge 14 by any suitable known biasing mechanism, such as a slightly bent surface, referenced as 18, on resilient plate 13, as illustrated in FIG. 1.

Figure 4:
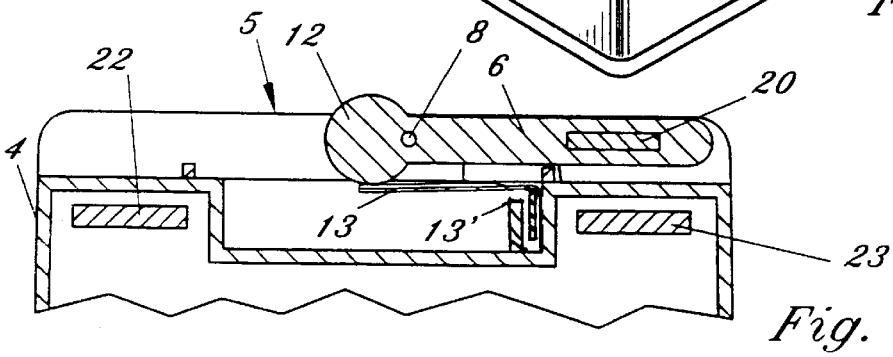
FIG. 4 is a sectional view taken along line 4—4 of FIG. 3*a*.

Referring to FIGS. 1 and 4, lever arm 6 may include an arcuate raised cam surface 12 at lower end 7. Resilient plate spring 13 can be used to press with tension on cam surface 12 such that force must be applied to lever arm 6 in order to rotate lever arm 6 about shaft 8. This is desirable since it is undesirable for lever arm 6 to freely rotate about shaft 8, as that would allow the lever arm to inadvertently shift into the "test" position and possibly drain the battery reserves. Biasing spring 13 can be a pre-bent and positioned piece of resilient metal, or other material, that has a "memory" such that when it is bent or deflected and released, it will return to its original position. Biasing spring 13 can be held in place by support member 13'. Spring 13 has an angled downward flange 18 on one side to aid movement of the lever arm laterally under biasing pressure or frictional force between plate 13 and lever arm 6 to prevent unintended or accidental movement of lever arm 6.

The raised cam surface 12 can be offset with respect to shaft 8 such that as lever arm 6 is rotated on shaft 8, the force of biasing spring 13 against arcuate raised portion 12 will increase, reaching a maximum when lever arm 6 is about 90 degrees with respect to the "on" or "off" starting position. Accordingly, the force of biasing spring 13 will decrease as lever arm 6 is rotated past 90 degrees toward the opposite side form which it started. The increased force required to flip lever arm 6 between the "on" or "off" position past the midpoint, or 90 degree position, provides additional protection from inadvertent activation. In addition, biasing spring 13 pressing against the raised cam surface 12 requires a positive force be applied against lever arm 6 to raise lever arm 6 from either its "on" or "off" resting position.

In one embodiment, magnet 20 can be provided in lever arm 6 to activate magnetic sensitive switches 22 and 23, which can be reed switches. Switches 22 and 23, when activated by magnet 20 can be utilized to selectively connect, or disconnect, electronic RF controls 24 to, or from, battery power 26. The batteries are preferably actually mounted to fully within the lower housing 2 and are shown as element 26 for simplicity. Reed switches 22 and 23 may be used in combination to provide for control via the position of magnet 20 within lever arm 6. For example, when lever 6 is in the "off" position, as shown in FIGS. 3*a* and 4, magnet 20 causes reed switch 23 to assume a closed position, while reed switch 22 assumes an open position. In this configuration, the device is deactivated and no power is drawn from battery source 26. When lever 6 is rotated 90 degrees to the "test" position shown in FIG. 3*b*, both switches 22 and 23 assume an open position which the control circuit 24 recognizes as the "test" position thereby indicating the status of the battery charge by illumination of light emitting device 32. When lever 6 is rotated an additional 90 degrees to the position shown in FIG. 3*c*, reed switch 22 assumes a closed position while reed switch 23 assumes an open position. In this configuration, the device is activated and control circuit 24 causes signals to be generated and transmitted via antenna 28.

As should be apparent, the present invention is also suitable for use with a single reed switch for providing on/off control, however, utilizing two switches 22 and 23, as shown in FIG. 4, provides three position control. In an alternate embodiment using one magnetically activated switch 22, biasing spring 13 can activate a conventional microswitch (not shown) when depressed by arcuate raised portion 12 upon raising lever arm 6 near the 90 degree vertical position.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A power switch for an emergency geographical personal locating device that can be an emergency position indicating radio beacon comprising:

a housing having a surface defining a first recessed cavity and a second recessed cavity, said first cavity positioned in offset alignment with said second cavity;

a shaft connected to said housing and mounted between said first recessed cavity and said second recessed cavity;

a lever arm rotatably and slidably mounted on said shaft, said lever arm movable between a first position wherein said lever arm substantially received within said first recessed cavity, and a second position wherein said lever arm is substantially received within said second recessed cavity;

said lever arm movable from said first position to said second position by rotation about said shaft to a third position between said first and said second position, said rotation of said lever arm being stopped at said third position by contact with a housing wall structure, said lever arm laterally slidable on said shaft to a fourth position wherein said lever arm does not contact said wall structure such that said lever arm may be further rotated to said second position;

means connected to said lever arm for activating an electric circuit.

2. A power switch for an emergency geographical personal locating device according to claim 1, wherein:

said lever arm is further rotatable from said second position to said first position, and during rotation from said second position to said first position said lever arm contacts at least a portion of an edge of said first recessed cavity, said at least a portion of said edge of said first recessed cavity being beveled wherein contact between said lever arm and said beveled edge causes said lever arm to laterally slide on said shaft when rotated toward said first position, whereby said lever arm returns to said first position.

3. A power switch for an emergency geographical personal locating device according to claim 1, and further comprising means for biasing said lever arm along said shaft from said fourth position toward said third position.

4. A power switch for a personal locating device as in claim 1, further comprising means for preselecting the approximate force required to rotate said lever arm about said shaft and to bias said lever arm into said first and said second position.

5. A power switch for an emergency geographical personal locating device according to claim 1, wherein said housing is waterproof and is substantially sized to be handheld and portable.

6. A power switch for an emergency geographical personal locating device according to claim 1, wherein said lever arm is flush with said housing surface when disposed in said first and second positions.

7. A power switch for an emergency geographical personal locating device that can be an emergency position indicating radio beacon comprising:

a housing having a surface defining a first recessed cavity and a second recessed cavity, said first cavity positioned in offset alignment with said second cavity;

a shaft connected to said housing between said first recessed cavity and said second recessed cavity;

a lever arm rotatably and slidably mounted on said shaft, said lever arm movable between a first position wherein said lever arm substantially received within said first recessed cavity, and a second position wherein said lever arm is substantially received within said second recessed cavity;

said lever arm including a permanent magnet;

said lever arm movable from said first position to said second position by rotation about said shaft to a third position between said first and said second position, said rotation of said lever arm being stopped at said third position by contact with a housing wall structure, said lever arm laterally slidable on said shaft to a fourth position wherein said lever arm does not contact said wall structure such that said lever arm may be further rotated to said second position;

at least one magnetically actuated switch for activating an electric circuit.

8. A power switch for an emergency geographical personal locating device according to claim 7, wherein said at least one magnetically actuated switch includes a first magnetically actuated switch disposed within said housing proximate said second recessed cavity, whereby said first magnetically actuated switch forms a closed electrical contact when said lever arm is disposed in said second position.

9. A power switch for an emergency geographical personal locating device according to claim 8, further including a second magnetically actuated switch disposed within said housing proximate said first recessed cavity, whereby said second magnetically actuated switch is forms a closed electrical contact when said lever arm is disposed in said first position.

10. A power switch for an emergency geographical personal locating device according to claim 9, wherein said first and second magnetically actuated switches each form an open electrical contact when said lever arm is in said third and fourth positions.

11. A power switch for an emergency geographical personal locating device according to claim 10, wherein:

said first position corresponds to power off;

said second position corresponds to power on; and said third position corresponds to battery test.

* * * * *